US009835175B2

(12) United States Patent
Crevel et al.

(10) Patent No.: US 9,835,175 B2
(45) Date of Patent: Dec. 5, 2017

(54) VENTILATION DEVICE

(71) Applicant: Valeo Systemes Thermiques, Le Mesnil Saint Denis (FR)

(72) Inventors: Herve Crevel, Tilly (FR); David Bonneau, Boulogne Billancourt (FR)

(73) Assignee: VALEO SYSTEMES THERMIQUES, Le Mesnil Saint Denis (FR)

( * ) Notice: Subject to any disclaimer, the term of this patent is extended or adjusted under 35 U.S.C. 154(b) by 352 days.

(21) Appl. No.: 14/386,413

(22) PCT Filed: Mar. 22, 2013

(86) PCT No.: PCT/EP2013/056150
§ 371 (c)(1),
(2) Date: Nov. 17, 2014

(87) PCT Pub. No.: WO2013/139982
PCT Pub. Date: Sep. 26, 2013

(65) Prior Publication Data

US 2015/0078937 A1 Mar. 19, 2015

(30) Foreign Application Priority Data

Mar. 22, 2012 (FR) ..... 12 52593

(51) Int. Cl.
*F04D 25/08* (2006.01)
*F04D 29/64* (2006.01)
(Continued)

(52) U.S. Cl.
CPC ..... *F04D 29/646* (2013.01); *F04D 19/002* (2013.01); *F04D 25/06* (2013.01);
(Continued)

(58) Field of Classification Search
CPC ..... F24F 7/007; F04D 19/002; F04D 25/06; F04D 25/08; F04D 25/0613;
(Continued)

(56) References Cited

U.S. PATENT DOCUMENTS 2,549,818 A * 4/1951 Joy ..... F16J 15/3268 92/168
2,965,373 A * 12/1960 Heiss ..... B60G 17/048 251/324
(Continued)

FOREIGN PATENT DOCUMENTS

DE 102009050369 A1 4/2011
WO WO 2010130577 A2 * 11/2010 ..... F04D 29/263
WO WO 2011047665 A2 * 4/2011 ..... F04D 25/08

OTHER PUBLICATIONS

English language abstract for DE 102009050369 extracted from espacenet.com database on Oct. 28, 2014, 2 pages. Also see English equivalent US 2012/0224988.
(Continued)

*Primary Examiner* — Peter J Bertheaud
*Assistant Examiner* — Dnyanesh Kasture
(74) *Attorney, Agent, or Firm* — Howard & HOward Attorneys PLLC

(57) ABSTRACT

A ventilation device includes a fan propeller (3) and a motor (5) with an external rotor (7*b*) for driving the propeller (3). The propeller (3) includes a central hub (11) having a frontal wall (17) and an internal first lateral wall (21) defining an accommodating housing for the external rotor (7*b*). The external rotor (7*b*) has a front part (9) and a second lateral wall (9") bearing against the internal first lateral wall (21) of the central hub (11). The ventilation device further includes a device for snap-fitting over the internal first lateral wall (21) to secure the external rotor (7*b*) to the central hub (11).

10 Claims, 4 Drawing Sheets

Figure 1:
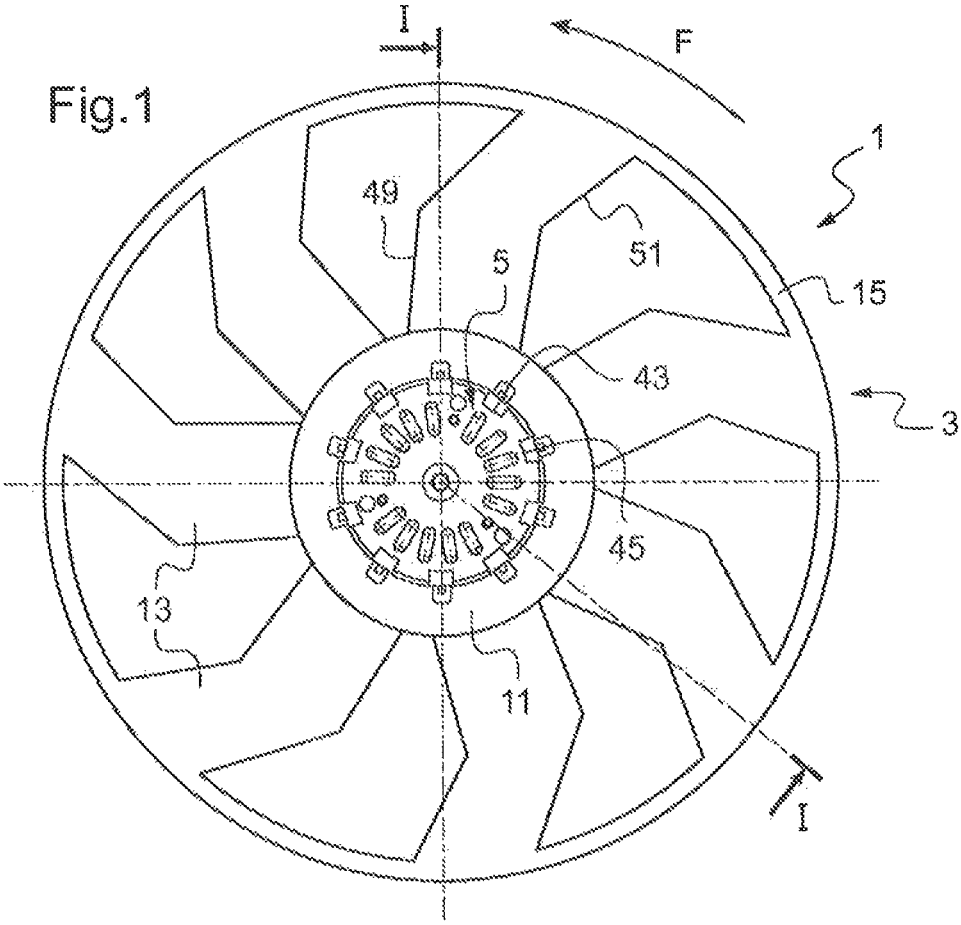

(51) Int. Cl.

| | |
|---|---|
| ***F04D 25/06*** | (2006.01) |
| ***F04D 29/32*** | (2006.01) |
| ***F04D 19/00*** | (2006.01) |
| ***F24F 7/007*** | (2006.01) |

(52) U.S. Cl.
CPC ..... *F04D 25/0613* (2013.01); *F04D 25/08* (2013.01); *F04D 29/329* (2013.01); *F24F 7/007* (2013.01)

(58) Field of Classification Search
CPC .... F04D 29/646; F04D 29/329; Y10T 24/344; Y10T 24/3443
See application file for complete search history.

(56) References Cited

U.S. PATENT DOCUMENTS

| | | | | |
|---|---|---|---|---|
| 5,944,497 | A | 8/1999 | Kershaw et al. | |
| 2003/0007844 | A1* | 1/2003 | Terry | F16B 39/282 411/186 |
| 2004/0075356 | A1* | 4/2004 | Horng | F04D 25/0613 310/154.08 |
| 2004/0126232 | A1 | 7/2004 | Lin et al. | |
| 2012/0183417 | A1* | 7/2012 | Linnenbrock | F04D 29/263 417/410.1 |
| 2012/0224988 | A1 | 9/2012 | Maier et al. | |

OTHER PUBLICATIONS

International Search Report for PCT/EP2013/056150 dated Sep. 10, 2013, 5 pages.

* cited by examiner

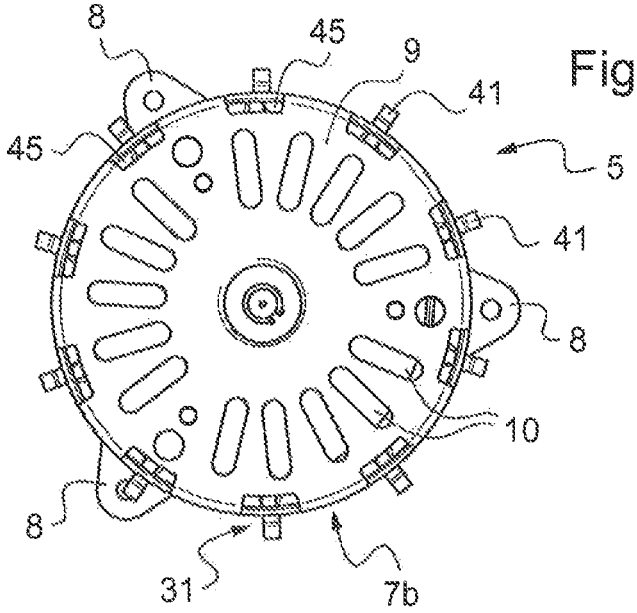
Fig.4a
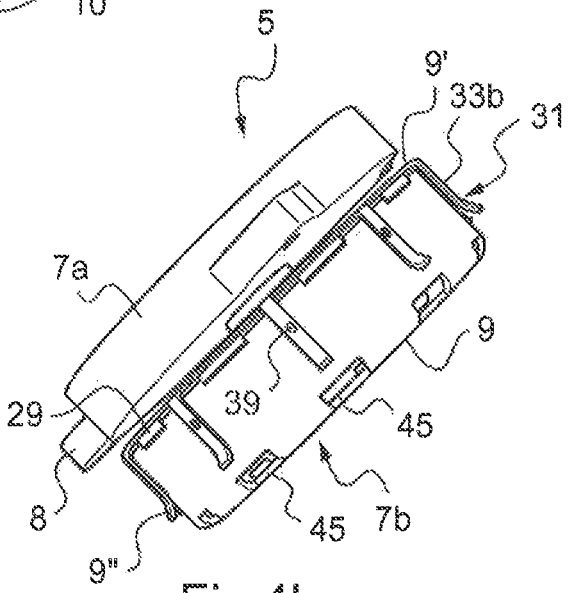
Fig.4b
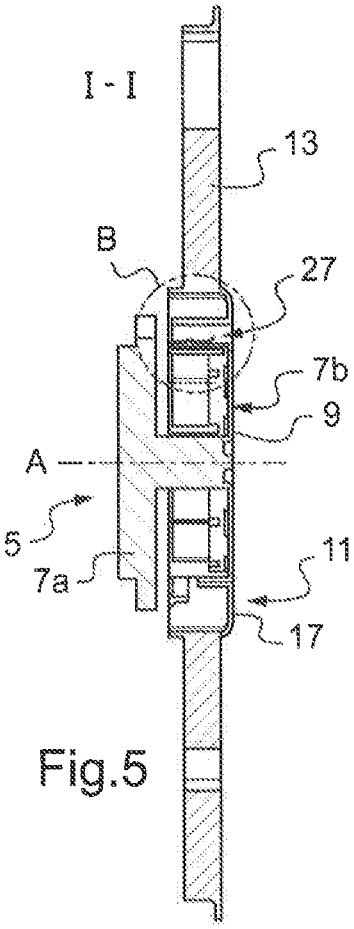
Fig.5
Fig.9
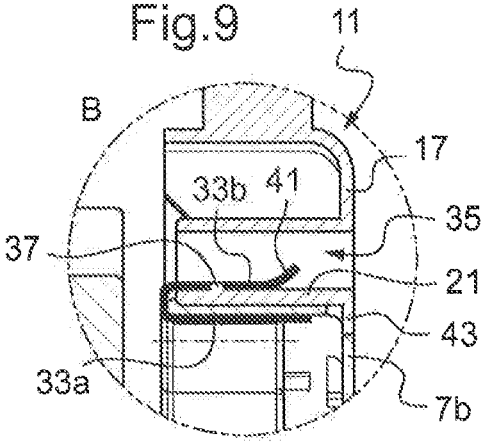

VENTILATION DEVICE

RELATED APPLICATIONS

This application is the National Stage of International Patent Application No. PCT/EP2013/056150, filed on Mar. 22, 2013, which claims priority to and all the advantages of French Patent Application No. FR 12/52593, filed on Mar. 22, 2012, the content of which is incorporated herein by reference.

The invention relates to a ventilation device comprising a fan propeller and a driving motor of the propeller.

A fan propeller traditionally comprises a central hub and blades extending radially from the hub to the outside of the propeller.

Such a propeller is notably used in the cooling of the driving engine of a motor vehicle. In this case, the propeller may be placed upstream or downstream of a heat exchanger, namely a radiator for cooling the driving engine.

According to a known configuration, the central hub of the propeller comprises a frontal wall and a substantially cylindrical peripheral skirt extending from the frontal wall and to which the blades of the propeller are connected.

The frontal wall has a substantially annular form and makes it possible for example to fix the electric motor that drives the rotation of the propeller.

This electric motor is mounted coaxial to the hub of the propeller.

The motor can have an internal rotor and the central hub is generally linked to the motor drive shaft.

When the motor has an external rotor in contact with the central hub, the fastening is generally done by screwing on the frontal wall of the hub of the propeller. In practice, according to one known solution, three screwing means are provided in proximity to the center of the frontal wall of the hub.

However, this solution requires a significant quantity of material to define the frontal wall of the hub.

Moreover, the current trend is to reduce the spaces or volumes under the engine hood. It is therefore necessary to propose ventilation devices that are increasingly more compact, notably in the axial bulk of such devices.

Now, in the known solution with screwing means on the frontal wall of the central hub, the thickness of these screwing means is added to the axial bulk of the ventilation device.

The aim of the invention is to at least partly mitigate these drawbacks of the prior art by proposing a ventilation device, that enables the hub to be fastened to the motor to drive the propeller in rotation, while offering an axially compact solution.

To this end, the subject of the invention is a ventilation device comprising a fan propeller and a motor with external rotor for driving said propeller, said propeller comprising a central hub having a frontal wall and an internal lateral wall defining an accommodating housing for the external rotor, and the external rotor having a front part and a lateral wall arranged bearing against the internal lateral wall of the central hub, characterized in that said device further comprises means for snap-fitting the external rotor to the central hub that are borne on the one hand by the central hub and on the other hand by the external rotor.

The terms "upstream" and "downstream", "front" and "rear" here refer to the direction of flow of the flow of air.

Thus, the frontal wall of the central hub can be open to receive the front part of the external rotor of the motor in a flush manner. It is no longer necessary to provide a significant quantity of material to define the frontal wall of the hub in as much as the fastening between the central hub and the motor is no longer done at this point.

On the contrary, the fastening means are designed in such a way that the internal lateral wall of the hub and the lateral wall of the external rotor are clamped together.

There is therefore no additional thickness in the axial bulk of the ventilation device due to the fastening means.

This system therefore makes it possible to minimize the number of components and simplifies the assembly operations.

Said ventilation device can further comprise one or more of the following features, taken separately or in combination:

- the snap-fitting means comprise a ring mounted on the external rotor and provided with a plurality of elastically deformable clamps, said clamps comprising, respectively, a first branch arranged bearing against the lateral wall of the external rotor and a second branch arranged bearing against the internal lateral wall of the central hub, so as to clamp together said rotor and said hub;
- the external rotor comprises a plurality of magnets and said clamps are arranged between said magnets;
- the central hub comprises a plurality of accommodating housings for said second branches;
- said housings of the central hub respectively comprise at least one snap-fitting hook and said second branches respectively comprise at least one orifice complementing said hook in which said hook is engaged;
- said second branches respectively comprise at least one snap-fitting hook and said housings of the central hub respectively comprise at least one orifice complementing said hook in which said hook is engaged;
- said second branches respectively have a substantially bent-back end;
- the frontal wall of the central hub has a central opening receiving the front part of the external rotor, and the frontal wall of the central hub and the front part of the external rotor are flush;
- said device comprises additional means for securing the motor and said hub in rotation, borne on the one hand by the external rotor and on the other hand by said hub;
- the frontal wall of said hub comprises radial protuberances that engage with complementary notches provided on the front part of said rotor;
- said hub has a predefined number of cylindrical bosses and the front part of the external rotor has complementary emergent holes into which said cylindrical bosses are inserted.

Figure 8:
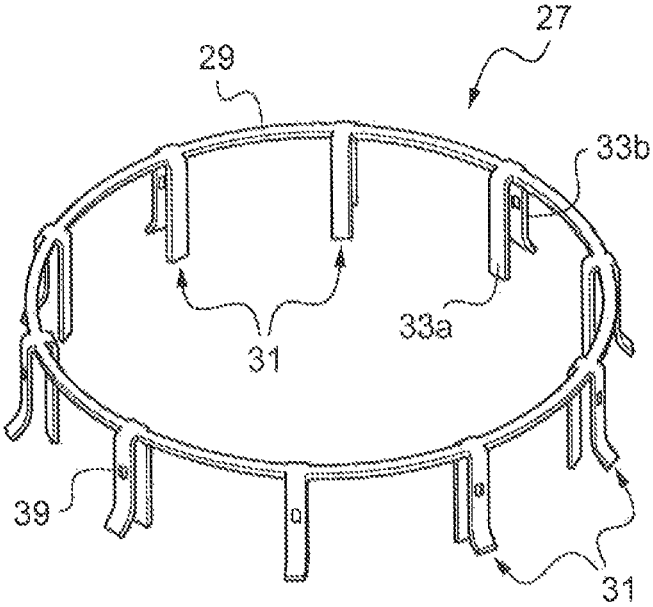
Figure 2:
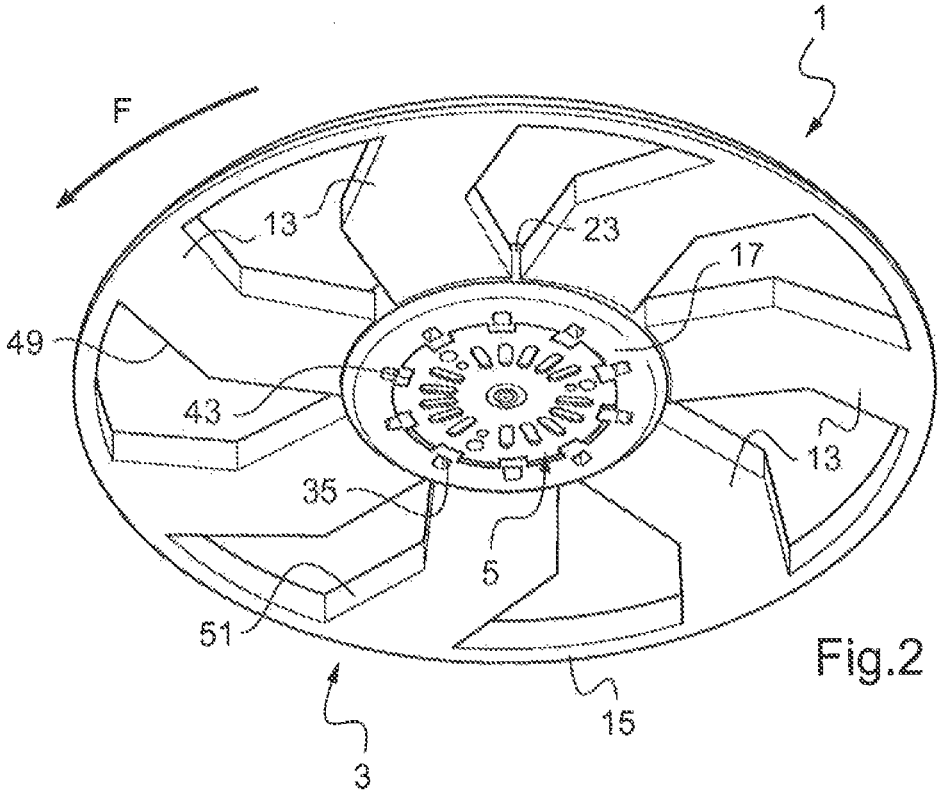
Figure 3:
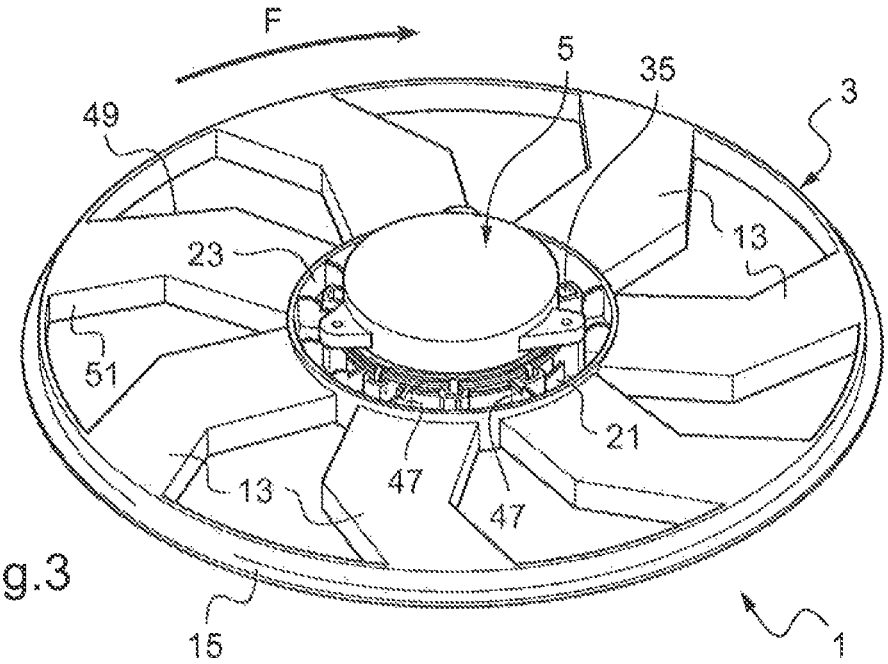
Figure 6:
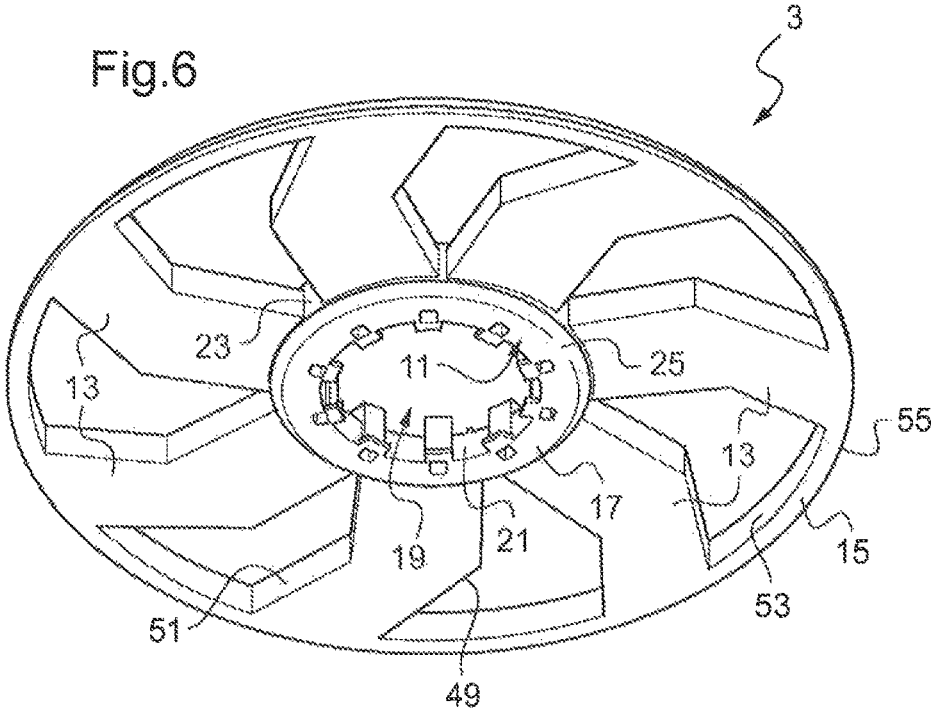
Figure 7:
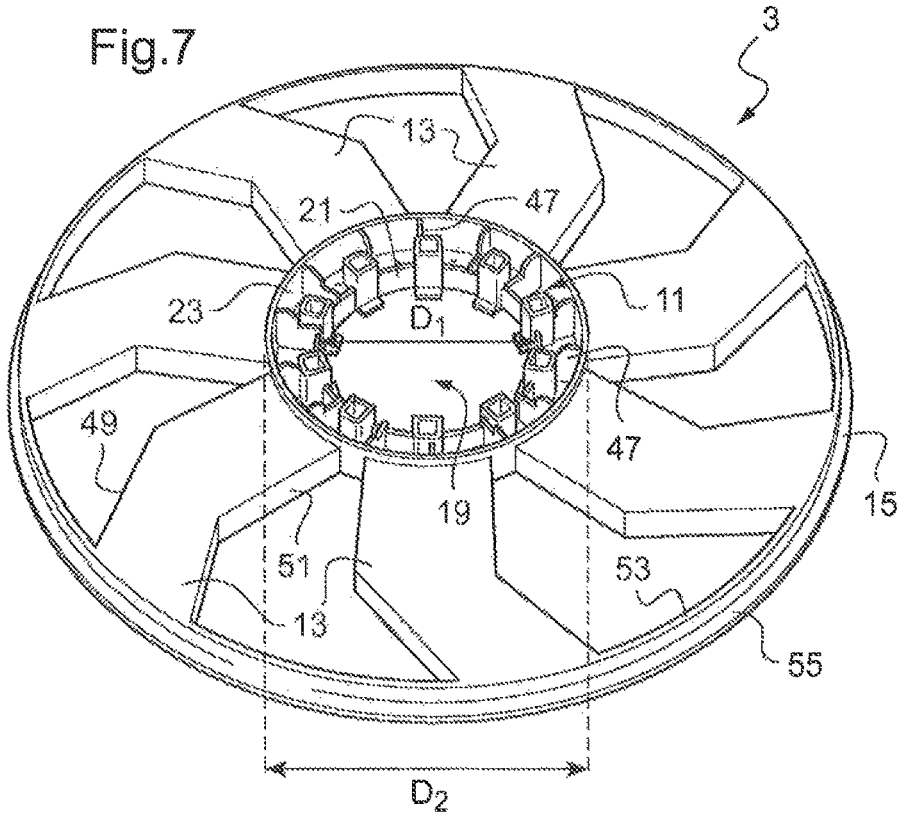

Other features and advantages of the invention will become more clearly apparent on reading the following description, given as an illustrative and nonlimiting example, and the attached drawings in which:

FIG. 1 is a front view of a ventilation device comprising a fan propeller and a driving motor, FIG. 2 is a perspective view of FIG. 1, FIG. 3 is a perspective view of the downstream face of the ventilation device in the direction of flow of the flow of air, FIG. 4*a* is a front view of the driving motor of the ventilation device of FIGS. 1 to 3, FIG. 4*b* is a perspective view of FIG. 4*a*, FIG. 5 is a view in cross section along an axis I-I of FIG. 1, FIG. 6 is a perspective view of the upstream face of the propeller of the ventilation device of FIG. 2 in the direction of flow of the flow of air, FIG. 7 is a perspective view of the downstream face in the direction of flow of the flow of air of the propeller of FIG. 5, FIG. 8 is a perspective view of a ring for attaching the rotor of the motor to the hub of the propeller, and FIG. 9 is an enlarged view of a portion B of FIG. 8 representing a clamp of the ring of FIG. 8 cooperating with a snap-fitting hook of the central hub of the propeller.

In these figures, the elements that are substantially identical bear the same references.

With reference to FIGS. 1 to 3, the invention relates to a ventilation device 1 comprising a fan propeller 3 and a driving motor 5 for the propeller 3.

It is notably a ventilation device 1 for a cooling module of a motor vehicle engine block (not represented). Such a cooling module generally comprises a heat exchanger such as a cooling radiator. The propeller 3 can be arranged either in front of or behind this cooling radiator.

The driving motor 5, more visible in FIGS. 4*a* and 4*b*, is an electric motor, which comprises, according to the embodiment described, a stator 7*a* and an external rotor 7*b*.

The stator 7*a* has at least one winding and the rotor 7*b* comprises one or more magnets. The rotor 7*b* comprises, for example, a number of magnets distributed over the circumference of the rotor 7*b*. The magnets are, according to the embodiment described, permanent magnets.

The stator 7*a* has fixing lugs 8 for fastening to a support (not represented).

The external rotor 7*b* is received in the central hub 11 of the propeller 3 (see FIGS. 1 to 3). A complementarity of form is therefore provided between the external rotor 7*b* and the central hub 11 of the propeller 3 for the rotational driving.

Referring once again to FIG. 4*b*, the external rotor 7*b* has a front part 9 and a rear part 9' opposite the front part 9. The terms "front" and "rear" are used with reference to the direction of flow of the flow of air.

The front 9 and rear 9' parts are linked together by a substantially cylindrical lateral wall 9".

According to the embodiment described, the lateral wall 9" of the external rotor 7*b* has an external face intended to be in contact with the central hub 11 during assembly, and an opposing internal face oriented toward the interior of the rotor 7*b*.

The front part 9 of the rotor 7*b* has through openings 10, more visible in FIG. 4*a*. The agitated flow of air passes through the openings 10 making it possible to cool the motor 5.

These openings 10 are, according to the embodiment represented, of substantially oblong form.

The openings 10 are for example evenly distributed.

The propeller 3 is driven in rotation about an axis of rotation A (see FIG. 5).

The direction of rotation of the propeller 3 is schematically represented by the arrow F in FIGS. 1 to 3.

When the propeller 3 is driven in rotation by the motor 5, the propeller 3 agitates the air which passes through it and creates a flow of air from upstream to downstream by communicating its rotational energy to it.

This propeller 3 is, for example, produced by plastic injection molding. The mold stripping of the propeller 3 can be done in an axial direction.

Referring to FIGS. 6 and 7, the propeller 3 comprises:

a central hub 11, a plurality of blades 13 which extend radially from the central hub 11, and a peripheral shell 15 to which the free ends of the blades 13 are connected.

The central hub 11 is hollow and is also called "bowl".

This central hub 11 is for example produced by molding at the same time as the rest of the propeller 3.

The central hub 11 is driven in rotation by the rotor 7*b*.

The rotational securing between the central hub 11 and the rotor 7*b* is for example obtained by complementarity of form between the central hub 11 and the rotor 7*b*.

This central hub 11 has:

an upstream frontal wall 17 having a central opening 19, an internal lateral wall 21, and a peripheral skirt 23.

In the present description, the terms "upstream" and "downstream" refer to the direction of flow of the flow of air produced by the rotation of the propeller 3.

The frontal wall 17 has a substantially annular form. This frontal wall 17 therefore has an internal first diameter $D_1$ which corresponds to the diameter of the opening 19, and an external second diameter $D_2$.

The frontal wall 17 is arranged flush with the front part 9 of the external rotor 7*b*.

The peripheral skirt 23 has a substantially cylindrical form. It extends downstream from the frontal wall 17.

The blades 13 are connected to this peripheral skirt 23.

The frontal wall 17 and the peripheral skirt 23 are for example linked together by a rounded section 25.

Similarly, the internal lateral wall 21 extends downstream from the frontal wall 17. This internal lateral wall 21 is substantially cylindrical and delimits the opening 19 of the frontal wall 17. The internal lateral wall 21 defines an accommodating housing for the driving motor 5 (see FIGS. 2, 3 and 6 and 7), more specifically for the external rotor 7*b* of the motor 5.

In particular, a complementarity of form is provided between the internal lateral wall 21 of the central hub 11 and the external rotor 7*b* of the motor 5.

This internal lateral wall 21 has an external face and an internal face opposite the external face. The external face of the internal lateral wall 21 is intended to be in contact with the external face of the lateral wall 9" of the external rotor 7*b* on assembly. The internal face of the internal lateral wall is arranged facing the peripheral skirt 23 of the hub 11.

The driving motor 5 is generally mounted coaxial to the central hub 11 of the propeller 3, as illustrated by FIGS. 1 to 3.

Once the motor 5 is assembled with the central hub 11, the frontal wall 17 of the central hub 11 is bearing against the front part 9 of the rotor 7*b*.

Furthermore, in order to ensure the mechanical secure attachment between the motor 5 and the hub 11, the ventilation device 1 comprises means for fastening the central hub 11 to the rotor 7*b*.

These fastening means are borne on the one hand by the central hub 11 and on the other hand by the external rotor.

They are, according to the embodiment described, snap-fitting means 27, more visible in FIGS. 5, 8 and 9, which make it possible to attach together the internal lateral wall 21 of the central hub 11 and the lateral wall 9" of the external rotor 7*b*.

The snap-fitting means 27 are for example borne by the rotor 7*b* and suitable for cooperating with the central hub 11.

More specifically, according to the embodiment illustrated in FIGS. 5 and 9, the snap-fitting means 27 are borne by the rotor 7*b* and cooperate with complementary means borne by the internal cylindrical wall 21 of the central hub 11.

As can be seen better in FIGS. 4*a*, 4*b* and 8, the snap-fitting means 27 comprise, according to the embodiment illustrated, a ring 29 mounted on the external rotor 7*b;* this ring 29 is provided with a plurality of elastically deformable clamps 31.

These clamps 31 are, for example, arranged between the magnets of the rotor 7*b*. This arrangement allows for the angular immobilization of the clamps 31.

More specifically, the ring 29 is mounted on the rear part 9' of the rotor 7*b*.

The clamps 31 can be evenly distributed by a predefined angular pitch, as in the example illustrated in FIG. 8.

Each clamp 31 comprises a first branch 33*a* and a second branch 33*b*.

On assembly of the motor 5 and the central hub 11, the first branch 33*a* of a clamp 31 is arranged bearing against the external rotor 7*b,* more specifically bearing against the internal face of its lateral wall 9" (FIGS. 3, 4*b* and 9).

For its part, the second branch 33*b* is arranged bearing against the central hub 11.

More specifically, a second branch 33*b* of a clamp 31 is for example received in a complementary housing 35 of the central hub 11. The hub 11 therefore comprises for this purpose a plurality of complementary housings 35 to receive the second branches 33*b* of the plurality of clamps 31.

These housings 35 are, according to the example illustrated, defined in the internal lateral wall 21 of the central hub 11.

The clamps 31 thus make it possible to hold together the external rotor 7*b* and the central hub 11 by clamping.

There is therefore no need to provide a significant quantity of material for the frontal wall 17 of the central hub 11 because the securing is not done at this frontal wall 17 but at the lateral walls 21 and 9" respectively of the central hub 11 and of the external rotor 7*b*. This frontal wall 17 can thus have a central opening 19 that is larger than in certain solutions known from the prior art.

Furthermore, the snap-fitting means are, according to the embodiment described, borne on the one hand by the central hub 11 and on the other hand by the clamps 31.

According to the example illustrated in FIG. 9, the housings 35 of the hub 11 respectively comprise at least one snap-fitting hook 37 and complementing this (see FIGS. 8 and 9), the second branches 33*b* of the clamps 31 respectively comprise at least one orifice 39 in which an associated hook 37 engages.

The cooperation between a snap-fitting hook 37 and an orifice 39 is more visible in FIG. 9 showing a close-up portion B of the cross-sectional view of FIG. 5.

The snap-fitting of the hook 37 in an associated orifice 39 makes it possible to secure the rotor 7*b* to the central hub 11 and to axially block the central hub 11 of the propeller 1 relative to the rotor 7*b*.

As an alternative, the snap-fitting hooks 37 can be borne by the second branches 33*b* of the clamps 31 and the housings 35 can comprise a complementary orifice in which the hook 37 is engaged.

Furthermore, the second branches 33*b* of the clamps 31 can respectively have a substantially bent-back end 41. This bent-back end 41 facilitates the insertion of the second branch 33*b* into the corresponding housing 35.

Furthermore, referring to FIGS. 1, 2 and 9, it is possible to provide, on the frontal wall 17 of the central hub 11, one or more radial protuberances 43 oriented toward the external rotor 7*b*.

Thus, according to the example illustrated in the figures, the central hub 11 has a plurality of protuberances 43. The protuberances 43 extend radially relative to the axis of rotation A of the propeller 3 and are oriented toward the rotor 7*b*.

A protuberance 43 engages a complementary notch 45 provided on the front part 9 of the rotor 7*b*. The rotor 7*b* therefore has, complementing the protuberances 43, a number of associated complementary notches 45. The notches 45 can be seen better in FIGS. 4*a* and 4*b*.

The cooperation between the protuberances 43 and the notches 45 completes the rotational securing of the central hub 11 to the rotor 7*b*.

A reverse construction can be envisaged in which it is the rotor 7*b* which has one or more protuberances suitable for engaging in an associated notch provided on the frontal wall 17 of the central hub 11.

Any other addition for securing the rotation of the central hub 11 and the motor 5 can be envisaged.

As a variant or as an alternative, the central hub 11 can have a predefined number of cylindrical bosses (not represented) and the front part 9 of the rotor 7*b* can have complementary emergent holes into which these cylindrical bosses are inserted.

Moreover, the central hub 11 can, furthermore, have internal ribs 47, visible in FIGS. 3 and 7.

These internal ribs 47 extend radially relative to the axis of rotation A of the propeller 3 opposite the blades 13.

These internal ribs 47 make it possible to rigidify the central hub 11.

These internal ribs 47 can also be used to force the ventilation into the central hub 11 so as to cool the driving motor 5 driving the propeller 3.

In practice, when the propeller 3 is driven in rotation, the internal ribs 47 agitate the air present inside the central hub 11. This air is therefore discharged toward the outside of the central hub 11 downstream, and, in addition, the aerodynamic force induced by the internal ribs 47 makes it possible to suck air into the driving motor 5 before discharging it also toward the outside of the central hub 11.

Furthermore, the internal ribs 47 can be evenly spaced at a predefined angular pitch.

Obviously, the internal ribs 47 may not be evenly spaced.

Moreover, the internal ribs 47 are for example produced by plastic injection molding in the same mold as the rest of the propeller 3.

In particular, the internal ribs 47 can be produced in a single piece with the central hub 11 by molding. The mold striping can still be done in an axial direction.

As a variant, the internal ribs 47 can be produced separately from the rest of the propeller 3 and then assembled with the propeller 3. Any means of assembling the internal ribs 47 with the central hub 11 can be envisaged.

With respect to the blades 13, they extend from the peripheral skirt 23 of the central hub 11 to the peripheral shell 15 (see FIGS. 1 to 3 and 6 and 7).

These blades 13 are generally identical.

The blades 13 respectively have a leading edge 49 which comes first into contact with the flow of air upon the rotation of the propeller 3, and a trailing edge 51 opposite the leading edge 49.

For its part, the shell 15 has a cylindrical wall 53, to which the ends of the blades 13 are connected, and which is continued, with a flare 55 (see FIG. 7).

Thus, the propeller 3 is clipped onto the external rotor 7*b* of the motor 5 via snap-fitting means 27 that are directly assembled on the external rotor 7*b*.

In practice, the rotor 7*b* is equipped with one or more clamps 31 secured to the rotor 7*b* via the ring 29 mounted on the external rotor 7*b*.

The central hub 11 of the propeller 3 is centered on the external diameter of the rotor 7*b* and is inserted into the clamps 31, the snap-fitting means on the clamps 31 lock the position of the propeller 3 and also allow for the rotational driving of the central hub 11 and therefore of the propeller 3, by the external rotor 7*b* of the motor 5.

This assembly makes it possible to have a compact solution.

In practice, the central hub 11 of the propeller 1 is flush with the frame of the motor 5. There is not additional thickness, as for example according to a prior art solution in which the fastening is done for example by screwing onto the frontal wall. This system therefore makes it possible to minimize the number of components and simplifies the assembly operations, in particular by comparison with the screwing-based prior art solution.

The invention claimed is:

1. A ventilation device comprising a fan propeller (3) and a motor (5) with an external rotor (7*b*) for driving the propeller (3), the propeller (3) comprising a central hub (11) having a frontal wall (17) and an internal first lateral wall (21) defining an accommodating housing for the external rotor (7*b*), and the external rotor (7*b*) having a front part (9) and a second lateral wall (9") bearing against the internal first lateral wall (21) of the central hub (11), wherein the device further comprises means (27) for snap-fitting over the internal first lateral wall (21) to secure the external rotor (7*b*) to the central hub (11);

wherein the snap-fitting means (27) comprise a ring (29) mounted on the external rotor (7*b*) and provided with a plurality of elastically deformable clamps (31), each of the clamps (31) comprising, respectively, a first branch (33*a*) bearing against the second lateral wall (9") of the external rotor (7*b*) and a second branch (33*b*) bearing against the internal first lateral wall (21) of the central hub (11), so as to clamp together the external rotor (7*b*) and the central hub (11); and wherein the external rotor (7*b*) comprises a plurality of magnets and each of the clamps (31) is arranged in a corresponding space between two of the plurality of magnets.

2. The device as claimed in claim 1, wherein the central hub (11) comprises a plurality of accommodating housings (35) for the second branches (33*b*), each second branch having a corresponding one of the plurality of accommodating housings (35).

3. The device as claimed in claim 2, wherein the housings (35) of the central hub (11) respectively comprise at least one snap-fitting hook (37) corresponding to a respective at least one orifice in a corresponding second branch of the plurality of second branches (33*b*), wherein the at least one hook (37) engages the at least one orifice.

4. The device as claimed in claim 2, wherein the second branches (33*b*) respectively comprise at least one snap-fitting hook (37), and wherein the housings (35) of the central hub (11) respectively comprise at least one orifice corresponding to a respective at least one snap fitting hook in a corresponding second branch of the plurality of branches, wherein the at least one hook (37) engages the at least one orifice.

5. A ventilation device comprising a fan propeller (3) and a motor (5) with an external rotor (7*b*) for driving the propeller (3), the propeller (3) comprising a central hub (11) having a frontal wall (17) and an internal first lateral wall (21) defining an accommodating housing for the external rotor (7*b*), and the external rotor (7*b*) having a front part (9) and a second lateral wall (9") bearing against the internal first lateral wall (21) of the central hub (11), wherein the device further comprises means (27) for snap-fitting over the internal first lateral wall (21) to secure the external rotor (7*b*) to the central hub (11), wherein the snap-fitting means (27) comprise a ring (29) mounted on the external rotor (7*b*) and provided with a plurality of elastically deformable clamps (31), each of the clamps (31) comprising, respectively, a first branch (33*a*) bearing against the second lateral wall (9") of the external rotor (7*b*) and a second branch (33*b*) bearing against the internal first lateral wall (21) of the central hub (11), so as to clamp together the external rotor (7*b*) and the central hub (11), and wherein the central hub (11) comprises a plurality of accommodating housings (35) for the second branches (33*b*), each second branch having a corresponding one of the plurality of accommodating housings (35).

6. The device as claimed in claim 5, wherein each of the housings (35) of the central hub (11) respectively comprise at least one snap-fitting hook (37) corresponding to a respective at least one orifice in a corresponding second branch of the plurality of second branches (33*b*), wherein the at least one hook (37) engages the at least one orifice.

7. The device as claimed in claim 5, wherein the second branches (33*b*) respectively comprise at least one snap-fitting hook (37), and wherein each of the housings (35) of the central hub (11) respectively comprise at least one orifice corresponding to a respective at least one snap fitting hook in a corresponding second branch of the plurality of second branches, wherein the at least one hook (37) engages the at least one orifice.

8. A ventilation device comprising a fan propeller (3) and a motor (5) with an external rotor (7*b*) for driving the propeller (3), the propeller (3) comprising a central hub (11) having a frontal wall (17) and an internal first lateral wall (21) defining an accommodating housing for the external rotor (7*b*), and the external rotor (7*b*) having a front part (9) and a second lateral wall (9") bearing against the internal first lateral wall (21) of the central hub (11), wherein the device further comprises means (27) for snap-fitting over the internal first lateral wall (21) to secure the external rotor (7*b*) to the central hub (11), wherein the snap-fitting means (27) comprise a ring (29) mounted on the external rotor (7*b*) and provided with a plurality of elastically deformable clamps (31), each of the clamps (31) comprising, respectively, a first branch (33*a*) bearing against the second lateral wall (9") of the external rotor (7*b*) and a second branch (33*b*) bearing against the internal first lateral wall (21) of the central hub (11), so as to clamp together the external rotor (7*b*) and the central hub (11), and wherein each of the second branches (33*b*) has a substantially bent-back end (41).

9. A ventilation device comprising a fan propeller (3) and a motor (5) with an external rotor (7*b*) for driving the propeller (3), the propeller (3) comprising a central hub (11) having a frontal wall (17) and an internal first lateral wall (21) defining an accommodating housing for the external rotor (7*b*), and the external rotor (7*b*) having a front part (9) and a second lateral wall (9") bearing against the internal first lateral wall (21) of the central hub (11), wherein the device further comprises means (27) for snap-fitting over the internal first lateral wall (21) to secure the external rotor (7*b*) to the central hub (11);

additional means for securing the motor (5) and the central hub (11) in rotation; and wherein the central hub (11) has a predefined number of cylindrical bosses, and wherein the front part (9) of the external rotor (7*b*) has complementary emergent holes into which the cylindrical bosses are inserted.

10. The device as claimed in claim 9, wherein the frontal wall (17) of the central hub (11) comprises radial protuberances (43) that engage with complementary notches (45) provided on the front part (9) of the external rotor (7*b*), wherein the central hub (11) has a predefined number of cylindrical bosses, and wherein the front part (9) of the external rotor (7*b*) has complementary emergent holes into which the cylindrical bosses are inserted.

* * * * *